US008598442B2

(12) United States Patent
Favre

(10) Patent No.: US 8,598,442 B2
(45) Date of Patent: Dec. 3, 2013

(54) PIN-BARREL FOR A MUSICAL BOX AND MUSICAL BOX COMPRISING THE SAME

(75) Inventor: Jérôme Favre, Les Bioux (CH)

(73) Assignee: Montres Breguet SA, L'Abbaye (CH)

( * ) Notice: Subject to any disclaimer, the term of this patent is extended or adjusted under 35 U.S.C. 154(b) by 3 days.

(21) Appl. No.: 13/333,360

(22) Filed: Dec. 21, 2011

(65) Prior Publication Data

US 2012/0192697 A1 Aug. 2, 2012

(30) Foreign Application Priority Data

Jan. 28, 2011 (EP) ..... 11152556

(51) Int. Cl.
*G10F 1/06* (2006.01)

(52) U.S. Cl.
USPC ..... 84/95.1

(58) Field of Classification Search
USPC ..... 84/95.1, 95.2, 94.1, 94.2, 97–99
See application file for complete search history.

(56) References Cited

U.S. PATENT DOCUMENTS

| | | | | |
|---|---|---|---|---|
| 2,735,328 | A | 2/1956 | Bangs et al. | |
| 2,880,639 | A * | 4/1959 | Gorr | 84/95.1 |
| 5,962,796 | A * | 10/1999 | Nakamura et al. | 84/97 |
| 6,268,554 | B1 | 7/2001 | Ashton | |
| 6,291,749 | B1 | 9/2001 | Tseng | |
| 2009/0097362 | A1 * | 4/2009 | Subilia et al. | 368/206 |

FOREIGN PATENT DOCUMENTS

| | | | |
|---|---|---|---|
| CH | 649 166 | A5 | 10/1999 |
| FR | 2 777 095 | A1 | 10/1999 |
| JP | 2003-150152 | A | 5/2003 |
| WO | WO 2008/007161 | A1 | 1/2008 |

* cited by examiner

*Primary Examiner* — Kimberly Lockett
(74) *Attorney, Agent, or Firm* — Sughrue Mion, PLLC

(57) ABSTRACT

The pin-barrel (1) is provided for a musical box in the form of a wristwatch. The pin-barrel is formed of a set of parallel pairs of strips (3, 3'), which are connected at one end thereof to a heel (2). Each pair of strips forms a tuning fork, wherein one of the strips (3') of the pair can be set in vibration by at least one pin of a musical module wherein the vibration propagates to the other strip (3) of the pair by a longitudinal wave.

13 Claims, 2 Drawing Sheets

PIN-BARREL FOR A MUSICAL BOX AND MUSICAL BOX COMPRISING THE SAME

This application claims priority from European Patent Application No. 11152556.4 filed 28 Jan. 2011, the entire disclosure of which is incorporated herein by reference.

FIELD OF THE INVENTION

The invention concerns a pin-barrel for a musical box of small dimensions, which may be in the form of a wristwatch.

The invention also concerns a musical box, which includes at least one pin-barrel of this type, notably for a musical wristwatch.

BACKGROUND OF THE INVENTION

In order to fit a musical module to a musical box in the form of a watch, the size of all of the components of the musical module must be reduced, while continuing to offer a varied melody, good quality sound and a high acoustic level. WO Patent No. 2008/007161 discloses such a musical module for a watch movement. The musical module includes at least one pin-barrel. The pin-barrel is formed of several metal strips or blades, arranged parallel to each other in one plane and connected to a heel, which is fixed to a watch plate. Each strip is capable of producing one sound of determined tonality according to its length. The strips are activated by pins of a rotating disc to produce a musical sound. The pins distributed over the rotating disc can raise or bend at least some of the strips and release them, causing them to vibrate, so as to produce a musical sound.

The acoustic performance, such as the duration of vibration of the activated strip or strips, depends upon several factors. These factors concern the geometry of each strip, such as the height and length thereof, the properties of the material, such as the modulus of elasticity, density and internal damping, any heat treatment or clamping or securing of the pin-barrel. If the size of the components of the musical module, which includes the pin-barrel, is reduced, the duration of vibration of the activated strips may be short, since the internal friction in the watch becomes greater relative to the effective mass of the pin-barrel. Even with the best possible pin-barrel for a musical module, which takes account of the aforementioned factors, it is difficult to optimise the duration of vibration of the activated pin-barrel strips of a musical box in the form of a watch, without obtaining undesired effects.

SUMMARY OF THE INVENTION

It is thus an object of the invention to provide a pin-barrel for a musical box, wherein the strips are configured to overcome the aforementioned drawbacks of the state of the art.

The invention therefore concerns a pin-barrel for a musical box, wherein the pin-barrel is formed of a set of pairs of strips, one of the ends of which being connected to a heel, each pair of strips forming a tuning fork, wherein a first strip of the pair can be set in vibration by an activation member, which is arranged underneath the first strip, of a musical module wherein the vibration is propagated to a second strip of the pair by a longitudinal wave, said second strip being arranged above the first strip.

Specific embodiments of the pin-barrel are defined in the dependent claims 2 to 9.

One advantage of the pin-barrel for a musical box lies in the fact that the pin-barrel is formed of a set of pairs of strips, where each pair of strips forms a tuning fork. Activation of one strip of a pair of strips causes the vibration to propagate to the other strip of the pair owing to a longitudinal wave. The vibration from the pair of strips can easily be guided to at least one radiating part of the musical box, which may be in the form of a wristwatch. A radiating part may be a plate or an acoustic membrane. An improvement in acoustic intensity is observed from the vibration of one or several pairs of strips. The acoustic sound produced by the pin-barrel is more pure, since only one natural mode of each pair of vibrating strips propagates towards the radiating parts.

The invention therefore concerns a musical box including a musical module provided with at least one pin-barrel and a set of activation members for activating the pairs of strips to produce a musical sound, the bin barrel being formed of a set of pairs of strips, one of the ends of which being connected to a heel, each pair of strips forming a tuning fork, wherein a first strip of the pair can be set in vibration by an activation member, which is arranged underneath the first strip, of a musical module wherein the vibration is propagated to a second strip of the pair by a longitudinal wave, said second strip being arranged above the first strip.

Specific embodiments of the musical box, particularly in the form of a watch, are defined in the dependent claims 11 to 13.

BRIEF DESCRIPTION OF THE DRAWINGS

The objects, advantages and features of the pin-barrel for a musical box and the musical box containing the same will appear more clearly in the following description, particularly with reference to the drawings, in which.

DETAILED DESCRIPTION OF THE INVENTION

In the following description, all the well known parts of the musical module of the musical box, which includes the pin-barrel according to the invention, will be described only briefly. The emphasis is mainly placed on the arrangement of the strips of the musical box pin-barrel.

Figure 1:
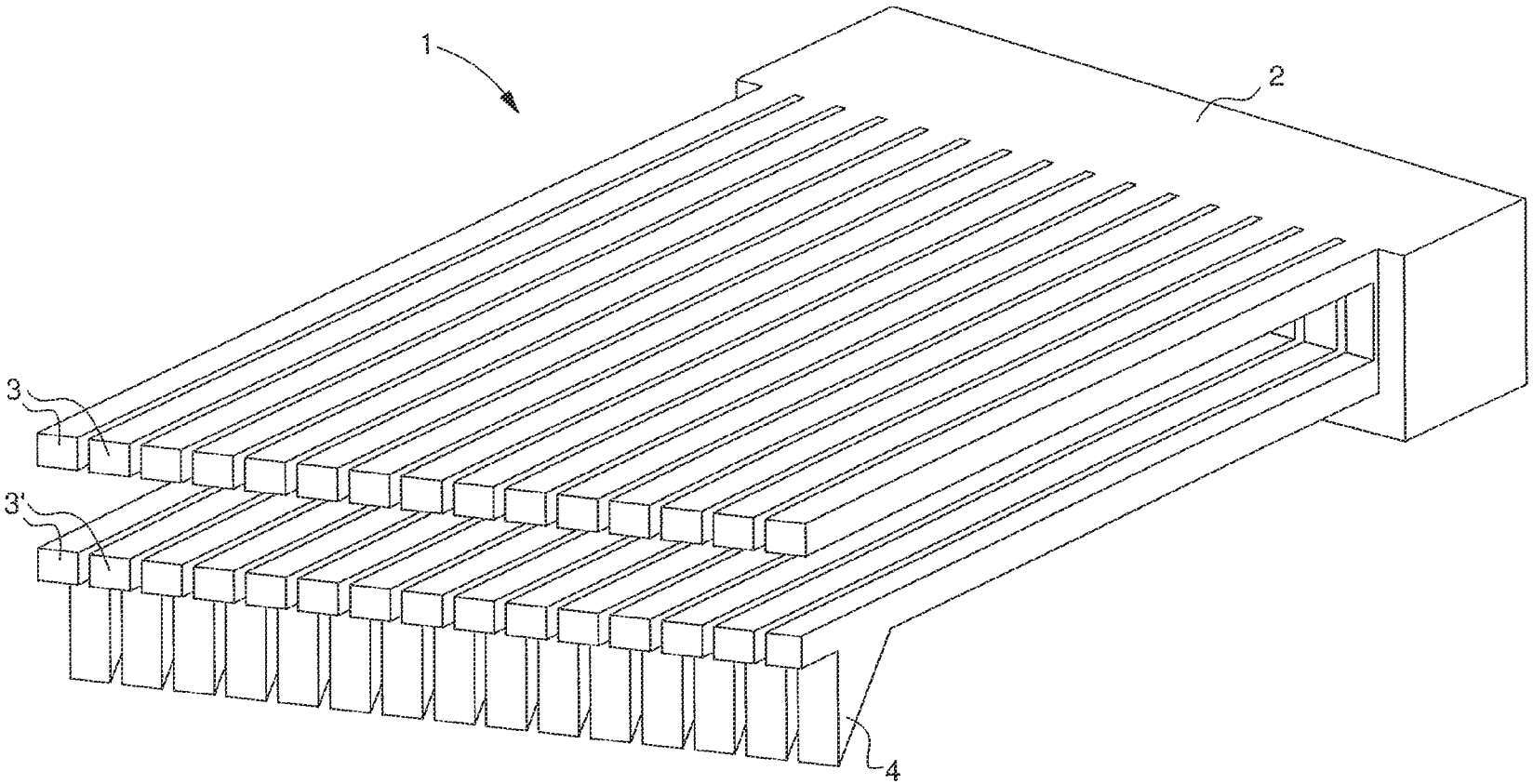
FIG. 1 shows a simplified three-dimensional view of a pin-barrel for a musical box according to the invention.

FIG. 1 shows a simplified three-dimensional view of a pin-barrel 1 for a musical box, which may be in the form of a wristwatch. Pin-barrel 1 forms part of a musical module of a musical box, or a watch striking mechanism, for generating music at determined periods.

Pin-barrel 1 includes a set of pairs of strips or blades 3, 3'. One end of each pair of strips is fixed to the same heel 2, which may be fixed, for example, to a board or a plate in the musical box or inside the case of a musical watch. Preferably, the strips are integral with the heel 2, so as to form a single part made of the same material. The material may be, for example, a metallic material, such as steel or copper, or a precious metal such as gold, or also a material with an amorphous structure, such as metallic glass.

A free end of one of strips 3, 3' also includes a cam-shaped element 4, which forms a ramp. The ramp preferably forms a slope defining an acute angle relative to the free end of strip 3'. An activation member, such as a pin, may come into contact with the ramp of cam 4 so as to raise or bend strip 3', when said activation member is moved in a parallel plane to strip 3' and in the direction of the free end of the strip. Once the activation member is moved beyond said cam 4, strip 3' is released causing it to vibrate and the vibration propagates to the other strip 3 as in a tuning fork.

The pairs of strips 3, 3' may be arranged parallel to each other. The two strips 3, 3' of each pair are preferably arranged at an equal distance from the two strips of an adjacent pair. However, it is also possible to imagine arranging the strips of all the pairs in the same plane.

Each strip may be of rectilinear shape with a rectangular, circular or other transverse section, which may be identical over the entire length of the strip. However, the transverse section can also vary gradually or discontinuously along the length of each strip. The length of the two strips of each pair may preferably be the same, so as to define a tuning fork, but they may also be of different dimensions.

All of the pairs of strips 3, 3' of pin-barrel 1 are dimensioned to produce a generally different note for each pair, when each pair is activated by a specific activation member of the musical module. However, it is also possible to have groups of pairs of two strips, which are capable of producing the same particular note.

As explained below with reference to FIGS. 2*a* to 2*c*, each activation member operates to set one of the two strips of an activated pair of strips in vibration. The vibration of one of the activated strips 3' propagates to the other strip 3 of the pair forming a tuning fork, by a longitudinal wave. This improves the acoustic intensity of each activated pair. Moreover, the sound generated by the pin-barrel is of better acoustic purity, given that a single natural vibration mode of each pair of vibrating strips propagates towards the radiating part of the musical watch.

Figure 2A:
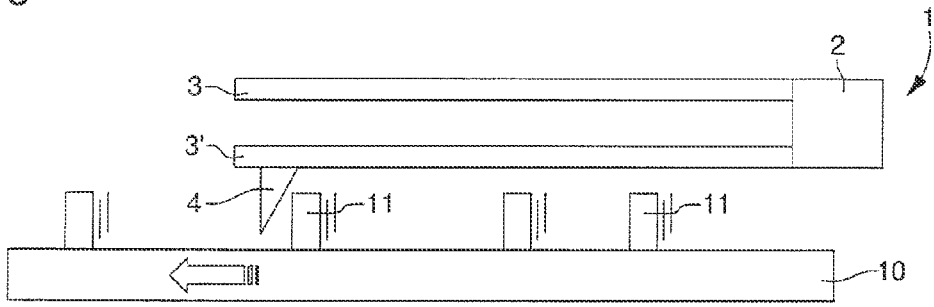
FIGS. 2*a* to 2*c* show, in a simplified manner, various operating steps of the musical module of the musical box for the activation of one or several strips of the pin-barrel according to the invention.
Figure 2B:
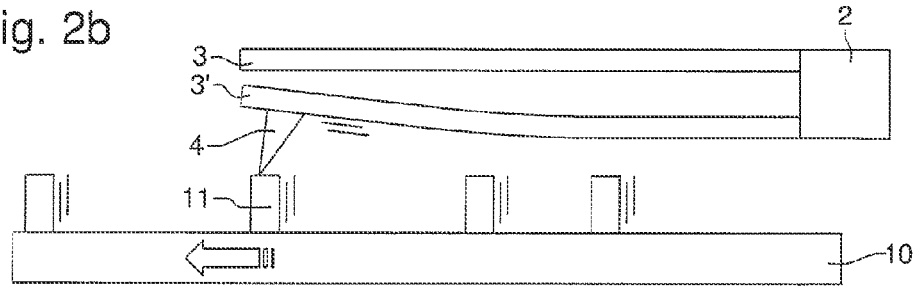
Figure 2C:
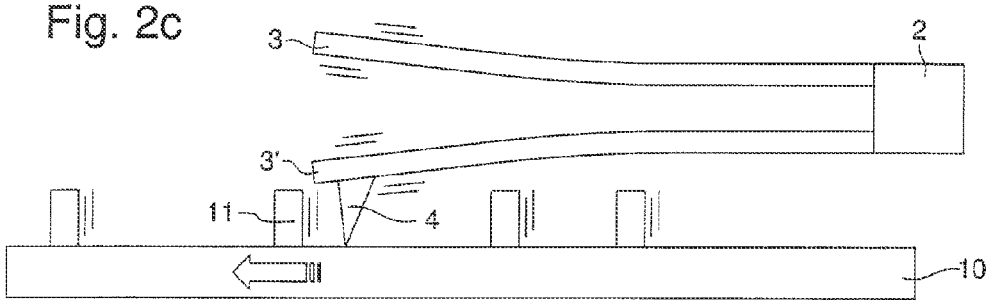

FIGS. 2*a* to 2*c* show different steps in the operation of the musical module provided with the pin-barrel according to the invention, in order to produce a musical sound. The schematically shown musical module also includes, in addition to pin-barrel 1, a cylinder or disc 10 on which a certain number of pins 11 are distributed as the activation members. The cylinder or disc 10 is arranged to rotate about a rotational axis perpendicular to the arrangement of the strips of all of the pairs of strips 3, 3'. Pins 11 are distributed over the cylinder or disc 10 to produce a specific musical sound when the cylinder or disc is rotated and different pairs of strips 3, 3' are activated in sequence.

In FIG. 2*a*, disc 10, which is arranged parallel to all of the strips of the pairs of strips 3, 3', is set in rotation about an axis perpendicular to the set of pairs of strips. The disc includes several pins 11 on one face of the disc, opposite strips 3, 3' and distributed to produce a specific musical sound. One of pins 11, in proximity to cam-shaped element 4, faces towards the free end of one strip 3' of the pair of strips shown, although it is not yet in contact with the ramp of cam 4.

In FIG. 2*b*, one of pins 11 of the disc comes into contact with cam 4 of strip 3'. This has the effect of raising or bending strip 3' when the pin moves on the ramp of cam 4 in the direction of the free end of strip 3'. The height of the cam and the pin, and the space between the pin and the strip, define the maximum possible bending of strip 3' caused by the movement of the pin in contact with cam 4. According to the desired bending value, it is possible to envisage, for example, moving the disc closer to or further from the pairs of strips.

In FIG. 2*c*, pin 11, which was previously in contact with cam 4 of strip 3', has moved beyond said cam, which has the effect of releasing strip 3', which starts vibrating to produce a determined note. The vibration generated in strip 3' also propagates to the other strip 3 of the pair forming a tuning fork, by a longitudinal wave. Thus, the note generated by the vibration of the pair of strips has acoustic purity in a single natural vibrating mode. The vibration from the pair of strips is advantageously transmitted to the external parts of the watch, for a high level of acoustic radiation of the produced sound.

Disc 10 or the cylinder may be mounted on the plate of the watch movement. Several discs or several cylinders with pins 11 can also be provided, if several sets of pairs of strips are secured on different lateral surfaces of the heel.

From the description that has just been given, those skilled in the art can devise several variants of the pin-barrel or watch case containing the same without departing from the scope of the invention defined by the claims. Instead of being rectilinear, the shape of each strip of the pairs of strips may define at least one curve. The strips of curvilinear shape may be arranged coaxially around a cylinder with pins. The strips of each pair may be removably fixed to the heel to allow one or several pairs to be changed depending upon the musical sound to be produced.

What is claimed is:

1. A pin-barrel for a musical box, wherein the pin-barrel is formed of a set of pairs of strips, one of the ends of which being connected to a heel, each pair of strips forming a tuning fork, wherein a first strip of the pair can be set in vibration by an activation member, which is arranged underneath the first strip, of a musical module wherein the vibration is propagated to a second strip of the pair by a longitudinal wave, said second strip being arranged above the first strip, and wherein a cam-shaped element is arranged in proximity to the free end of the first strip of each pair to allow one of several activation members, depending upon the musical module, to abut against the cam to raise or bend and then release the strip to set said strip in vibration.

2. The pin-barrel according to claim 1, wherein all of the pairs of strips are arranged parallel to each other.

3. The pin-barrel according to claim 2, wherein the strips of each pair are arranged at the same distance from the strips of an adjacent pair.

4. The pin-barrel according to claim 1, wherein each pair of strips is integral with the heel so as to form a single part.

5. The pin-barrel according to claim 1, wherein the strips of each pair are rectilinear.

6. The pin-barrel according to claim 1, wherein the length of the strips of each pair is identical, but different from one pair to another.

7. The pin-barrel according to claim 1, wherein the transverse section of each strip is identical over the entire length thereof.

8. The pin-barrel according to claim 1, wherein the transverse section of each strip varies gradually or discontinuously along the length of each strip.

9. The musical box including a musical module provided with at least one pin-barrel according to claim 1 and a set of activation members for activating the pairs of strips to produce a musical sound.

10. The musical box according to claim 9, wherein it is made in the form of a musical watch.

11. The musical box according to claim 9, wherein the set of activation members is a disc, on one surface of which opposite the pairs of strips of the pin-barrel, there are pins distributed in a specific manner according to the music to be produced by the rotation of the disc and the sequential activation of certain strips of the pairs of strips via the movement of the pins.

12. The musical box according to claim 9, wherein the set of activation members is a cylinder, on the external surface of which there are pins distributed in a specific manner according to the music to be produced by the rotation of the cylinder and the sequential activation of certain strips of the pairs of strips by the movement of the pins.

13. A pin-barrel for a musical box, wherein the pin-barrel is formed of a set of pairs of strips, one of the ends of which being connected to a heel, each pair of strips forming a tuning fork, wherein a first strip of the pair can be set in vibration by an activation member, which is arranged underneath the first strip, of a musical module wherein the vibration is propagated to a second strip of the pair by a longitudinal wave, said second strip being arranged above the first strip.

* * * * *